US008056602B1

(12) United States Patent
Green

(10) Patent No.: US 8,056,602 B1
(45) Date of Patent: Nov. 15, 2011

(54) SCREEN COVER RETAINER STRIP ASSEMBLY

(75) Inventor: Guerry E. Green, Pawleys Island, SC (US)

(73) Assignee: Marhaygue, LLC, Pawleys Island, SC (US)

( * ) Notice: Subject to any disclaimer, the term of this patent is extended or adjusted under 35 U.S.C. 154(b) by 181 days.

(21) Appl. No.: 12/356,174

(22) Filed: Jan. 20, 2009

(51) Int. Cl.
*A47H 13/00* (2006.01)

(52) U.S. Cl. ..... 160/392; 160/395

(58) Field of Classification Search ..... 160/392, 160/395, 394, 397, 386, 391; 52/222, 273, 52/202, 63
See application file for complete search history.

(56) References Cited

U.S. PATENT DOCUMENTS

| | | | | | |
|---|---|---|---|---|---|
| 1,350,027 | A | | 8/1920 | Lane | |
| 2,797,750 | A | * | 7/1957 | Van Dette | 160/392 |
| 2,897,889 | A | | 8/1959 | Kessler | |
| 3,143,165 | A | * | 8/1964 | Lewis et al. | 160/394 |
| 3,199,258 | A | | 8/1965 | Jentoft et al. | |
| 3,220,469 | A | | 11/1965 | Oehmig | |
| 4,038,791 | A | | 8/1977 | Atkinson | 52/36 |
| 4,084,360 | A | | 4/1978 | Reckson | 52/63 |
| 4,233,790 | A | | 11/1980 | Meadows | 52/222 |
| 4,261,144 | A | | 4/1981 | Rizzo | 52/63 |
| 4,274,234 | A | | 6/1981 | Abell | 52/63 |
| 4,333,284 | A | * | 6/1982 | Meadows | 52/222 |
| 4,410,027 | A | | 10/1983 | Lucous | 160/380 |
| 4,503,640 | A | | 3/1985 | Stern | 49/425 |
| 4,638,532 | A | * | 1/1987 | Yang et al. | 24/462 |
| 4,662,038 | A | | 5/1987 | Walker | 24/460 |
| 4,665,670 | A | | 5/1987 | van den Burg | 52/222 |
| 4,690,192 | A | | 9/1987 | Stilling | 160/57 |
| 4,731,960 | A | | 3/1988 | Sease | 52/36 |
| 4,799,299 | A | * | 1/1989 | Campbell | 24/462 |
| 4,817,655 | A | * | 4/1989 | Brooks | 135/121 |
| 4,899,797 | A | | 2/1990 | Green | 160/395 |
| 5,046,546 | A | | 9/1991 | Benedyk et al. | 160/371 |
| 5,143,138 | A | | 9/1992 | Zwart | 160/395 |
| 5,209,029 | A | * | 5/1993 | Foerst | 52/63 |
| 5,242,004 | A | * | 9/1993 | Stilling | 160/57 |
| 5,613,544 | A | * | 3/1997 | Schaefer | 160/395 |
| 5,802,800 | A | | 9/1998 | Meyers | 52/731.21 |
| 5,823,704 | A | * | 10/1998 | Koch et al. | 403/396 |
| 5,904,022 | A | | 5/1999 | Zadok | 52/650.1 |
| 5,906,078 | A | * | 5/1999 | Cramer | 52/222 |
| 5,910,084 | A | | 6/1999 | Koike et al. | 52/204.1 |
| 6,192,643 | B1 | | 2/2001 | Zadok | 52/648.1 |
| 6,295,783 | B1 | | 10/2001 | Davis | 52/736.3 |
| 6,385,941 | B1 | | 5/2002 | Power, Jr. et al. | 52/731.3 |
| 6,412,250 | B2 | | 7/2002 | Davis | 52/736.3 |
| 6,668,495 | B1 | | 12/2003 | Prince | 52/63 |
| 6,758,014 | B2 | * | 7/2004 | Chen | 52/63 |
| 6,945,305 | B1 | | 9/2005 | Limauro | 160/369 |
| 2005/0236120 | A1 | | 10/2005 | Johnson | 160/404 |

* cited by examiner

*Primary Examiner* — David Purol
(74) *Attorney, Agent, or Firm* — Sara Centioni Kanos; Nexsen Pruet, LLC

(57) ABSTRACT

A retainer strip assembly for securing screening and screen covering and the like to a framing member comprises a base strip, cover strip and cap strip fastened to the framing member, the cap strip covering the base strip and holding in place the screening and screen covering, and the cover strip contained within the base strip for avoiding the tearing or fraying of screen covers when the cap strip is placed on or removed from the base strip while installing or removing screen covers.

15 Claims, 3 Drawing Sheets

SCREEN COVER RETAINER STRIP ASSEMBLY

BACKGROUND OF THE INVENTION

The present invention relates to retainer strips for screens and screen covers, and, more particularly, to low-profile, universal retainer strips for removably fastening screen covers to framed screens and the like, such as are used for porches.

Screened porches remain a popular addition to constructions, as they enhance the enjoyment of the out-of-doors regardless of ambient conditions. The screening blocks the entry of insects and admits air to the area of the porch so enclosed. Although meshed screens are ideal to block the entry of undesired objects, while still maintaining a comfortable temperature for the occupants, these screens must frequently be replaced because of damage or degradation. Additionally, the screening can become dirty so as to require cleaning, which cannot be done effectively with the screens in place and it is impractical to clean the screens by removing them completely.

Typically, porches are screened by erecting a simple wooden framing to enclose the porch in a series of panels and to which framing the screening material is nailed or tacked. The nails or tacks are covered with furring strips to give the structure a finished appearance. Removal of the screening, therefore, involves prying off the furring strips and pulling the nails or tacks from the framing with the resulting damage to the framing. Furthermore, the screening may run over several panels so that a large area of screening may have to be replaced to effect a repair needed in only one panel.

In some areas of the country, such as along the sea coast, where screening is especially susceptible to damage, and where relatively frequent replacement of screening is necessary, elaborate framing with removable screened elements is available. This framing is usually made of aluminum and is relatively expensive to install. It also lacks the flexibility of wood framing and, to some, the aesthetic appeal of painted or stained wood.

One device for attaching screens to framing is described in U.S. Pat. No. 4,899,797, issued to the present inventor, which is incorporated herein by reference. In this prior art device, a low-profile, universal retaining strip is provided for removably fastening screens and the like to framing.

During colder months, screen covers are temporarily used over screening to keep porches warmer by both blocking cold air from flowing into the porch and helping to keep warmer air within the porch. This approach is sometimes referred to as "winterizing," which results in "winterized" porches. These screen covers are typically thin clear plastic, such as made from polyethylene or vinyl. The more fitted these covers are to the mesh screens, the more effective they are at maintaining a comfortable porch climate. Although a snug fit between the screens and the screen covers can be achieved through the use retaining strips, such as the Green device, these strips oftentimes tear or fray the screen covers during either the removal or installation of the covers. Furthermore, screen covers can neither be repaired nor reused once they are torn.

Accordingly, there remains a need for a retaining strip that can removably fasten both screens and screen covers without also damaging the screen covers.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

According to its major aspects and briefly stated, the present invention includes a screen cover retainer strip assembly having a cap strip removably fastened onto a base strip that is fastened to a framing member. The base strip includes at least one narrow groove for receiving and holding temporarily a spline with a screen, and a channel for receiving and holding temporarily a cover strip and a screen cover. The cap strip covers the spline and base strip and assists in securing the spline within the narrow groove. Additionally, the cap strip assists in securing both the cover strip and the screen cover within the channel.

The present invention has a low profile, being only slightly thicker than a spline and is preferably an extruded all-weather, resilient plastic in white or other desirable color for low maintenance. Alternatively, the base strip may be made of aluminum or other metal and only the cap strip and cover strip made of plastic. The cap strip serves primarily to hold the cover strip, screen cover and spline in place, and cover the base strip including the heads of nails or screws used to fasten the base strip to the framing member. So embodied, the strip assembly does not detract from the appearance of the structure to which the screening is to be fastened. Cap strip removal is easily accomplished by inserting a screw driver or other narrow lever at any point along the interface between base strip and cap strip and prying the two apart. The cap once loosened will peel off to allow access to the screen and screen cover for replacement.

A feature of the present invention includes the use of a cover strip to within the channel of a base strip. So as to maintain the enjoyment of screened porches, screen covers are typically a thin layer of transparent plastic. Accordingly, screen covers are easily damaged, and oftentimes cut, when contacted by an edge. The cover strip of the present invention helps to prevent this type of screen cover from being cut, torn or frayed, especially by the interaction between the cap strip and the base strip, during either the application or replacement of the cover.

Another feature of the present invention includes the use of a cap strip dimensioned to removably retain a cover strip within the channel of a base strip. The cap strip is dimensioned to bear against the cover strip so as to hold the screen cover in place without tearing or fraying the screen cover during the application or replacement of the screen cover.

Other features and advantages of the present invention will be apparent to those skilled in the art from a careful reading of the Detailed Disclosure of the Preferred Embodiment presented below and accompanied by the drawings.

DETAILED DESCRIPTION OF THE PREFERRED EMBODIMENT

The present invention is screen cover retainer strip assembly for use in attaching both a screen and a screen cover to framing, such as in porches. The present retainer strip assembly is an improvement over prior art retainer strips in that it removably fastens screen covers to framing without also damaging the screen covers.

Figure 1:
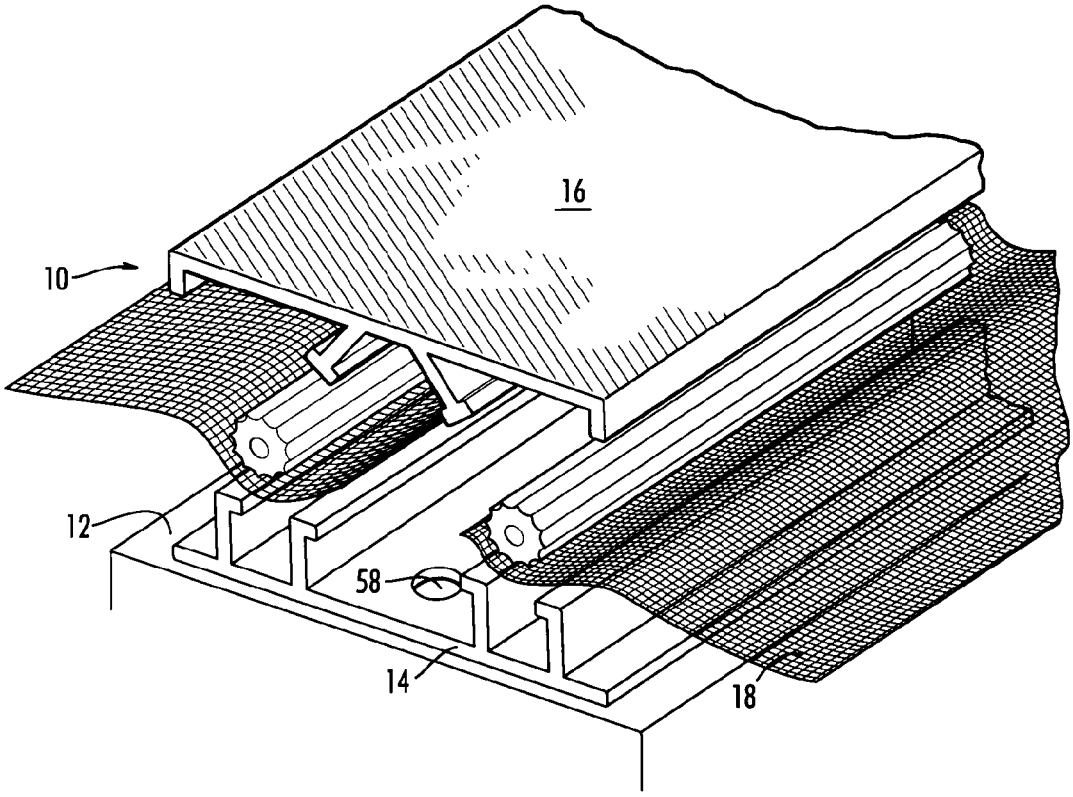
FIG.1 PRIOR ART
FIG. 1 is an exploded perspective view of a prior art retainer strip assembly.
Figure 2:
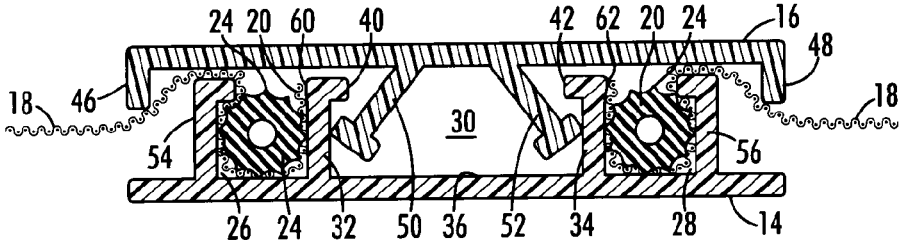
FIG.2 PRIOR ART
FIG. 2 is an end view of a prior art retainer strip assembly.

Referring now to the figures, FIGS. 1-2 represent a prior art retainer strip assembly shown in a perspective view and generally indicated by reference number 10. The retainer strip assembly 10 shown is secured to a framing member 12. Assembly 10 comprises a base strip 14 and a cap strip 16 both running parallel to the long dimension of framing member 12.

Retainer strip assembly 10 may be used to secure any type of flexible sheeting such as cloth, canvas, plastic or mesh screening to framing member 12. FIG. 1 shows a mesh screen 18 secured to frame member 12.

As shown in FIG. 2, showing an end view of retainer strip assembly of FIG. 1, screen 18 is fastened to either side of retainer strip assembly 10 where a marginal portion 20 of screen 18 surrounds a resilient, cylindrical spline 22 having a series of teeth 24 about its exterior surface (as best seen in FIG. 2). Spline 22 is received by a narrow groove 26. When retainer strip assembly 10 is fastened to an intermediate framing member having screening on either side, such as shown in FIG. 1, a second groove 28 receives a second spline. Grooves 26 and 28 are sufficiently narrow so that a spline received therein is held temporarily; that is, grooves 26 and 28 can hold spline 22 with screen 18 and exerting a small amount of tension on spline 22 without spline 22 slipping out of groove 28. Alternatively, when retainer strip assembly is fastened to an end framing member having screening on one side, only one groove is required.

Between groove 26 and 28 is a channel 30 defined by a left wall 32, a right wall 34 and a floor 36. Screws or nails can be driven through the floor 36 of channel 30 to hold base strip 14 to frame member 12. Preferably, holes 58 (shown in FIG. 1) may be drilled into floor 36 at the time of fabrication to assist in the attachment of base 14 to frame member 12. Alternatively, base strip 14 can be glued to frame member 12.

Left wall 32 and right wall 36 have inwardly protruding lips 40 and 42, respectively, and outwardly protruding bulges 60 and 62. Cap strip 16 both serves to cover base strip 14 and to hold spline 22 in place. Cap strip 16 has a top 44, a left side 46 and a right side 48 substantially covering base strip 14. Under top 44 are a left catch 50 and a right catch 52 positioned between left and right walls, 32, 34, respectively of base strip 14. So positioned, catches 50, 52 hook onto the protruding lips 40, 42 of left and right walls 32, 34, respectively.

In addition to holding cap strip 16 to base strip 14, catches 50, 52 bear outwardly against left and right walls 32, 34, respectively, which thereby pinch splines in the grooves and assist in holding screen 18 against substantial tension.

The sides of cap strip 16 finish the side appearance of retainer strip assembly 10 and also fold screen 18 down around the outside of groove 28, adding further resistance against the dislodging of spline 22 and screen 18. A left outer wall 54 and right outer wall 56 of base strip 14 are slightly recessed to create slits between base strip 14 and the sides of cap strip 16 for insertion of a tool such as a screw driver to pry cap strip 16 from base strip 14 without the screw driver bearing directly against frame member 12.

Cap strip 16 and base strip 14 can both be made of a resilient plastic, each extruded in any appropriate color, or made of metal. When in place, the retainer strip assembly has a low, unobtrusive profile.

If desired, retainer strip assembly 10 can be made with only one groove for use as a retainer strip assembly attached to end framing members.

Figure 3:
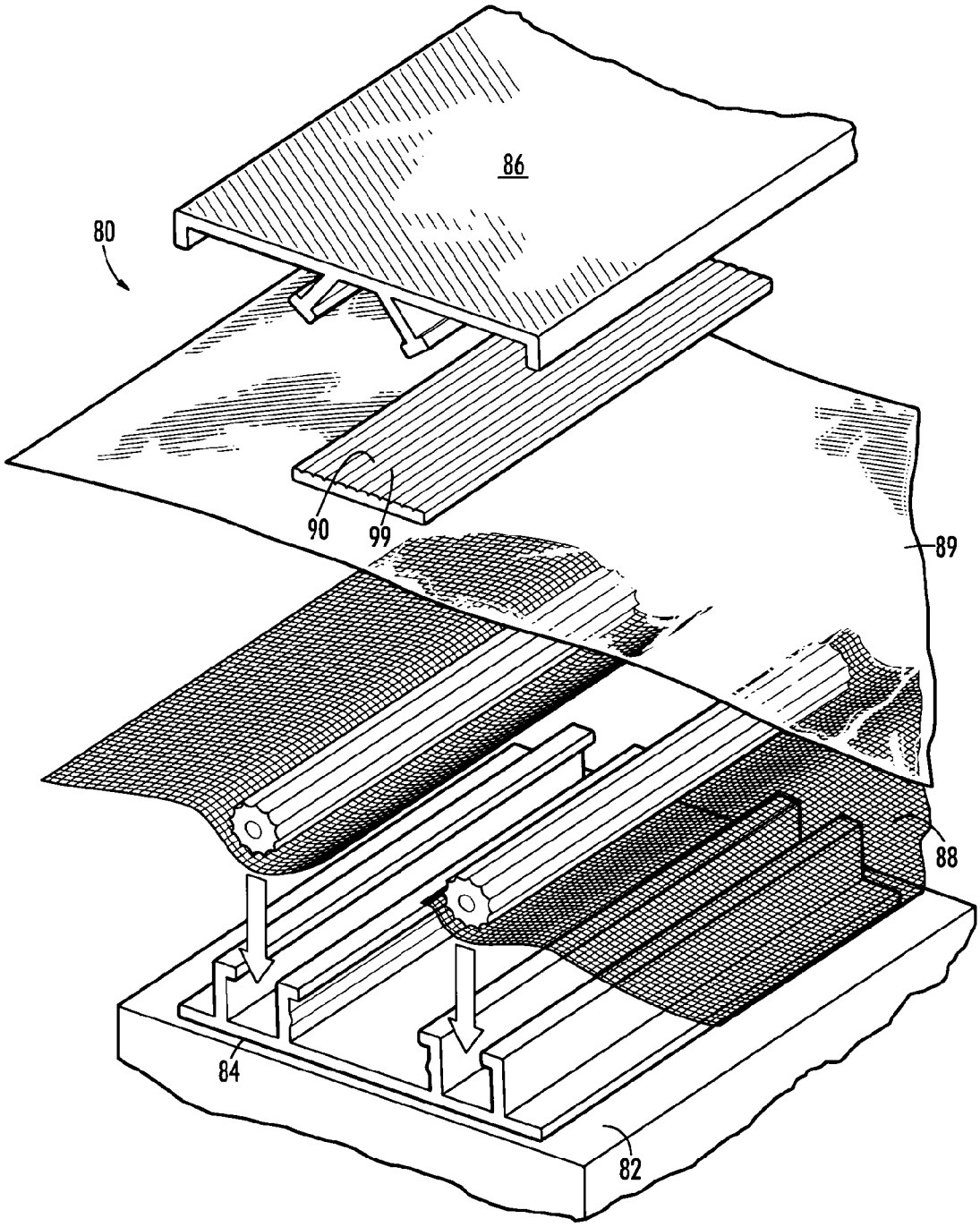
FIG. 3 is an exploded perspective view of a retainer strip assembly according to the present invention.
Figure 4:
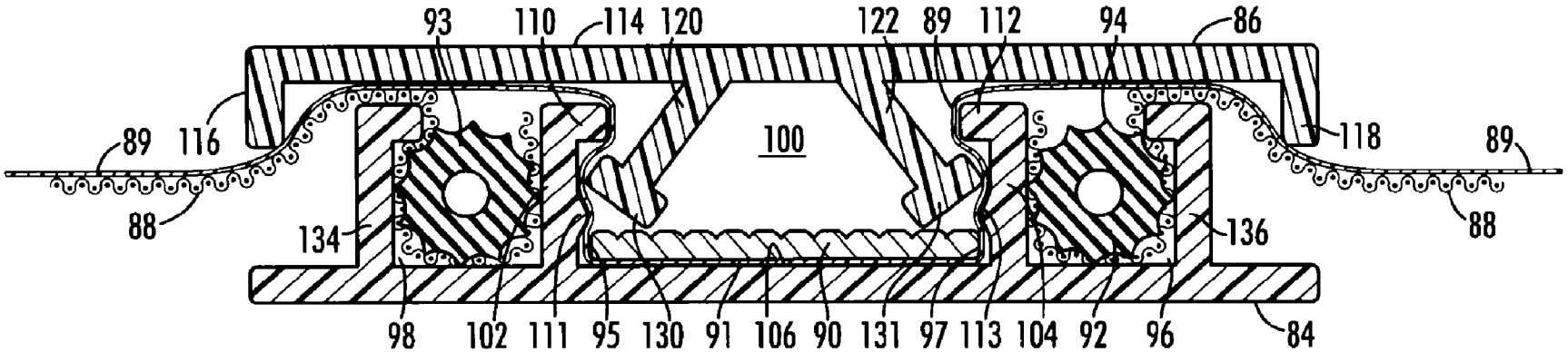
FIG. 4 is an end view of a retainer strip assembly according to the present invention.

FIGS. 3-4 illustrate perspective and end views of a present retainer strip assembly 80 which represents an improvement over retainer strip assembly 10. Like retainer strip assembly 10, assembly 80 is secured to a framing member 82. Assembly 80 comprises a base strip 84, a cover strip 90 and a cap strip 86, each running parallel to the long dimension of framing member 82.

Retainer strip assembly 80 may be used to secure any type of flexible sheeting such as cloth, canvas, plastic or mesh screening, as well as screen covering, to framing member 82. FIG. 4 shows a mesh screen 88 and a sheer screen cover 89 secured to frame member 82. In particular, the screen cover 89 can be made of a thin, clear plastic, such as polyethylene or vinyl. The purpose of the screen cover 89 is to winterize a porch so that it can be enjoyed by users during colder months or in colder climates.

As further illustrated in FIG. 4, showing an end view of retainer strip assembly 80 of FIG. 3, screen 88 is fastened to either side of retainer strip assembly 80 where a marginal portion of screen 88 surrounds a major portion of a first resilient, cylindrical spline 92 having a series of teeth 94 about its exterior surface. Spline 92 is received by a narrow groove 96. A second groove 98 can also receive a second spline 93 when retainer strip assembly 80 is fastened to an intermediate framing member having screening on either side, such as shown in FIGS. 3-4. Grooves 96 and 98 are sufficiently narrow so that a spline received therein is held temporarily; that is, grooves 96 and 98 can hold splines 92, 93 with screen 88 and exerting a small amount of tension on splines 92, 93 without splines 92, 93 slipping out of grooves 96, 98. Alternatively, when retainer strip assembly 80 is fastened to an end framing member having screening on only one side, only one groove is required.

Between groove 96 and 98 is a channel 100 defined by a left wall 102 and a right wall 104 separated by a floor 106. Left wall 102 and right wall 104 of channel 100 have inwardly protruding lips 110 and 112, respectively. As shown, channel 100 is dimensioned to receive screen cover 89 and cover strip 90. Cover strip 90 is surrounded by screen cover 89 when the assembly is in place. Preferably, cover strip 90 has a flat, rectangular shape with a bottom surface 91 next to the floor 106, and side walls 95, 97 next to the left wall 102 and right wall 104 of channel 100, respectively. Additionally, left wall 102 and right wall 104 preferably include inwardly protruding flanges 111 and 113, respectively, that extend longitudinally and that are dimensioned to releasably retain cover strip 90 and screen cover 89 within the channel 100, such as by a loose snap-fit. The outer surface, including top surface 99, of cover strip 90 can either be smooth or ridged, such as shown in FIGS. 3-4.

Similar to previous retainer assembly 10, screws or nails can be driven through the floor 106 of channel 100 to hold base strip 84 to frame member 82. Accordingly, holes (not shown) may be drilled into floor 106 at the time of fabrication to assist in the attachment of base 84 to frame member 82. Alternatively, base strip 84 can be glued to frame member 82.

Cap strip 86 serves to cover base strip 84 and to hold both screen cover 89 and splines 92, 93 in place. Cap strip 86 has a top 114, a left side 116 and a right side 118 substantially covering base strip 84. Under top 114 are a left catch 120 and a right catch 122 positioned between left and right walls, 102, 104, respectively of base strip 84. Preferably, catches 120, 122 include a left and right end flange 130, 131, respectively. So positioned, one side of left and right end flanges 130, 131 hook onto the protruding lips 110, 112 of left and right walls 102, 104, respectively, while the other side of left and right end flanges 130, 131, abut or bear on cover strip 90, respectively. Additionally, inwardly protruding flanges 111 and 113 can also assist in holding catches 120, 122 in place.

When screen cover 89 is applied, screen cover 89 is preferably wrapped over grooves, 96, 98, around catches 120, 122 and beneath cover strip 90. A feature of the present invention includes the use of cap strip 86 in combination with cover strip 90 within channel 100 of base strip 84. Catches 120, 122 of cap strip 86 are dimensioned to bear outwardly against left and right walls 102, 104, respectively, and thus assist in holding screen cover 89 against substantial tension, as shown in FIG. 4. Furthermore, because catches 120, 122 also abut cover strip 90, potential tearing and fraying of the screen cover 89 by catches 120, 122 is avoided. Inwardly protruding flanges 111 and 113 further assist in both maintaining the cover strip 90 and screen cover 89 in place, as well as positioning the catches 120, 122 for holding the cover strip 90 and screen cover 89 within the channel 100.

In addition to holding cap strip 86 to base strip 84, and holding cover strip 90 and screen cover 89 in place, catches 120, 122 also assist in pinching splines 92, 93 in grooves 96, 98 and thus in holding screen 88 against substantial tension, as seen in FIG. 4.

The sides of cap strip 86 finish the side appearance of retainer strip assembly 80 and also fold both screen 88 and screen cover 89 down around the outside of grooves 96, 98, adding further resistance against the dislodging of splines 92, 93, screen 88, and screen cover 89. A left outer wall 134 and right outer wall 136 of base strip 84 can be slightly recessed to create slits between base strip 84 and the sides of cap strip 86 for insertion of a tool such as a screw driver to pry cap strip 86 from base strip 84 without the screw driver bearing directly against frame member 82.

Cap strip 86, base strip 84, and cover strip 90 can be made of a resilient plastic, each extruded in any appropriate color, or made of metal. When in place, the retainer strip assembly has a low, unobtrusive profile.

The foregoing description of preferred embodiments of the invention has been presented for purposes of illustration and description. It is not intended to be exhaustive or to limit the invention to the precise form disclosed, and obviously many modifications and variations are possible in light of the above teachings. The embodiments were chose and described in order to best explain the principles of the invention and its practical application to thereby enable one skilled in the art to best utilize the invention in various embodiments and with various modifications as are suited to the particular use contemplated. It is intended that the scope of the invention be defined by the claims appended hereto.

What is claimed is:

1. A retainer strip assembly for fastening a screen cover and a screen to a frame member, comprising:

a resilient longitudinal spline for winding a marginal portion of said screen thereabout, said spline having a generally circular cross-section;

a base strip having at least one narrow groove and a channel parallel to the long dimension of said base strip, wherein said channel is defined by a left wall and a right wall separated by a floor, wherein said floor is flat between said left wall and said right wall, said groove holding temporarily said spline within said groove so that said spline does not readily pull out;

a cover strip contained within said channel of said base strip, said screen cover surrounding said cover strip, wherein said cover strip has a bottom surface, and wherein the entire of said bottom surface abuts said floor; and a cap strip releasably secured to and covering said base strip, wherein said cap strip includes means for holding said cover strip and said screen cover in said channel and said screen in said groove, wherein said holding means abuts said cover strip.

2. The assembly of claim 1, wherein said base strip has two of said grooves and said channel is between said grooves.

3. The assembly of claim 2, wherein said holding means is a left catch and a right catch depending downwardly from said cap strip, said left catch and said right catch being positioned between said left wall and said right wall, respectively, of said base strip, wherein said left catch and said right catch have a bearing relationship with said left wall, said right wall, and said cover strip.

4. The assembly of claim 3, wherein said left and said right walls each has an inwardly protruding lip, wherein said left catch is located so as to releasably lock onto said protruding lip of said left wall of said channel, and wherein said right catch is located so as to releasably lock onto said protruding lip of said right wall of said channel, said left and right catches in bearing relationship with said protruding lips of said left and right walls, respectively.

5. The assembly of claim 4, wherein said left catch and said right catch each include an end flange, wherein one side of said end flange is located so as to releasably lock onto one of said protruding lips, and wherein the other side of said end flange is located so as to bear on said cover strip.

6. The assembly of claim 1, wherein said cover strip includes a top surface, and opposing side walls, and wherein said holding means bears on said top surface.

7. The assembly of claim 1, wherein said left wall and said right wall each include an inwardly protruding flange extending longitudinally and dimensioned to releasably retain said cover strip within said channel.

8. The assembly of claim 1, wherein the exterior surface of said cover strip is ridged.

9. The assembly of claim 1, wherein said cap strip is made of resilient plastic.

10. The assembly of claim 1, wherein said cap strips has a top, a left side, an opposing right side, wherein said left and said right sides of said cap strip fold said screen and said screen cover around said left and said right outer walls, respectively, of said base strip to provide resistance to dislodging said spline.

11. The assembly of claim 1, further comprising a frame member, wherein said base strip is connected to said frame member.

12. The assembly of claim 1, wherein said screen cover is made of a transparent plastic material.

13. The assembly of claim 12, wherein said plastic is polyethylene.

14. The assembly of claim 12, wherein said plastic is vinyl.

15. A retainer strip assembly for fastening a screen cover and a screen to a frame member, comprising:

a resilient longitudinal spline for winding a marginal portion of said screen thereabout, said spline having a generally circular cross-section;

a base strip having at least one narrow groove and a channel parallel to the long dimension of said base strip, wherein said channel is defined by a left wall and a right wall separated by a floor that is flat between said left wall and said right wall, said groove holding temporarily said spline within said groove so that said spline does not readily pull out;

a flat cover strip contained within said channel of said base strip, said screen cover surrounding said flat cover strip; and a cap strip releasably secured to and covering said base strip, wherein said cap strip includes means for holding said flat cover strip and said screen cover in said channel and said screen in said groove, wherein said holding means abuts said flat cover strip.

* * * * *